US006146053A

United States Patent [19]

Nelson

[11] Patent Number: 6,146,053

[45] Date of Patent: Nov. 14, 2000

[54] WEIGHT BELT APPARATUS FOR SCUBA DIVERS

[76] Inventor: William M. Nelson, 517 E. Melody La., Gilbert, Ariz. 85234

[21] Appl. No.: 09/208,395

[22] Filed: Dec. 9, 1998

[51] Int. Cl.[7] ..... B63C 11/00

[52] U.S. Cl. ..... 405/186; 405/185; 224/664; 224/934

[58] Field of Search ..... 405/185, 186; 224/230, 664, 934

[56] References Cited

U.S. PATENT DOCUMENTS

| | | | |
|---|---|---|---|
| 2,558,382 | 6/1951 | Previdi . | |
| 3,361,312 | 1/1968 | Hutchison | 224/240 |
| 3,436,777 | 4/1969 | Greenwood . | |
| 3,664,560 | 5/1972 | Perkins . | |
| 3,949,916 | 4/1976 | Yount | 224/26 R |
| 4,174,793 | 11/1979 | Wisowaty . | |
| 4,323,181 | 4/1982 | Spasoff . | |
| 4,440,525 | 4/1984 | Perla . | |
| 4,732,305 | 3/1988 | Courtney et al. . | |
| 4,798,497 | 1/1989 | Bloos . | |
| 4,808,033 | 2/1989 | Belmonte | 405/186 |
| 4,907,729 | 3/1990 | Hess, III | 224/253 |
| 4,923,105 | 5/1990 | Synder | 224/255 |
| 4,957,231 | 9/1990 | Kalisher | 224/151 |
| 5,076,575 | 12/1991 | Eylander | 405/186 X |
| 5,121,864 | 6/1992 | Geschwind | 224/230 |
| 5,205,672 | 4/1993 | Stinton | 405/186 |
| 5,331,721 | 7/1994 | Raum, Sr. | 24/3 |
| 5,392,974 | 2/1995 | Johnson-rabbett | 224/253 |
| 5,611,470 | 3/1997 | Vias et al. | 224/240 |
| 5,641,247 | 6/1997 | Seligman | 405/186 |
| 5,683,022 | 11/1997 | Evans | 224/583 |
| 5,746,542 | 5/1998 | Carmichael | 405/186 |
| 5,836,497 | 11/1998 | Pelish | 224/677 |
| 5,855,454 | 1/1999 | Courtney et al. | 405/186 |
| 5,944,450 | 8/1999 | Anderson | 405/186 |

*Primary Examiner*—David Bagnell
*Assistant Examiner*—Jong-Suk Lee
*Attorney, Agent, or Firm*—H. Gordon Shields

[57] ABSTRACT

Weight belt apparatus for divers includes a belt with one or more sleeves disposed on the belt and adjustable thereon for the convenience of the diver using the apparatus. Each sleeve includes one or more pouches for receiving and holding weights. The pouches are collapsible for convenience when no weight is disposed therein.

9 Claims, 1 Drawing Sheet

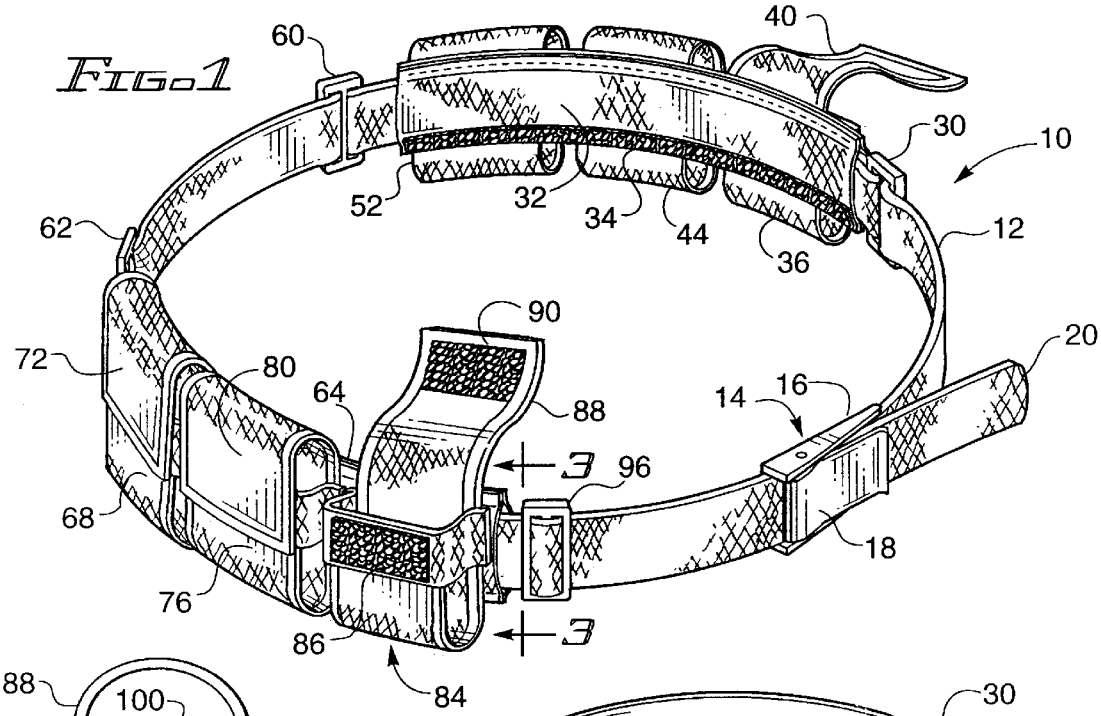
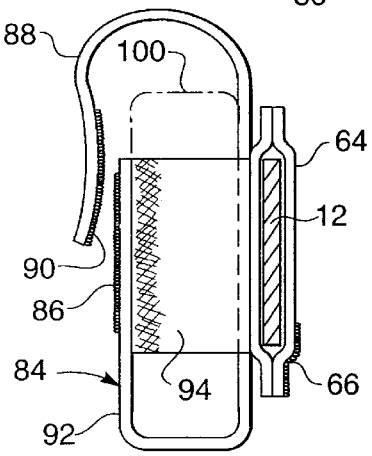
FIG. 3
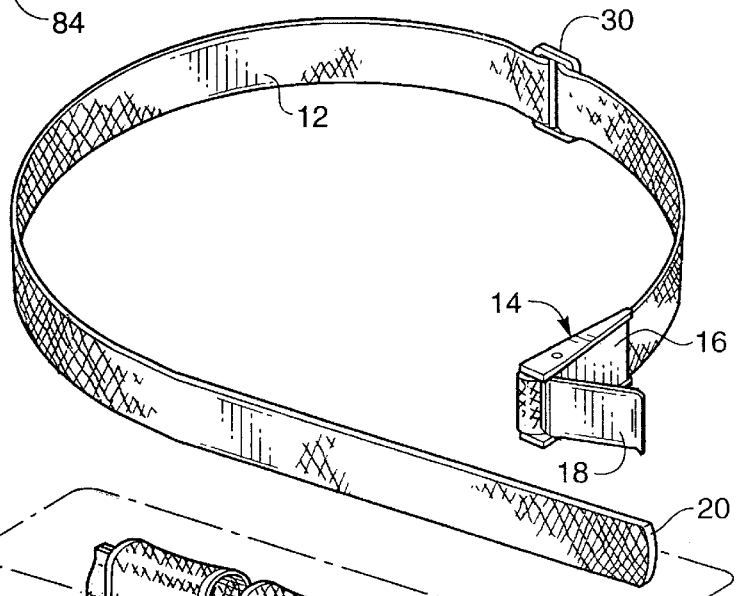
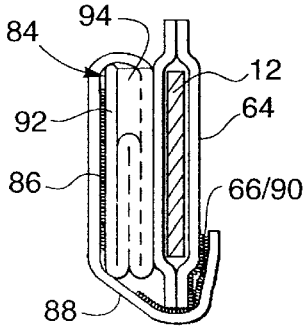
FIG. 4
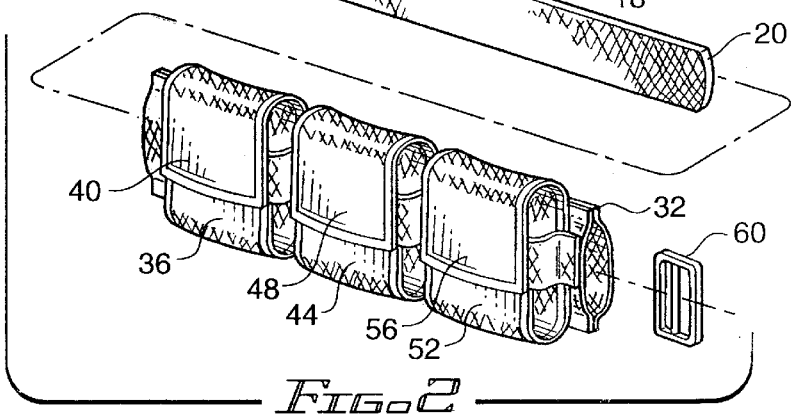
FIG. 2

WEIGHT BELT APPARATUS FOR SCUBA DIVERS

BACKGROUND OF THE INVENTION

1. Field of the Invention

This invention relates to belts and, more particularly to belts for holding weights for scuba divers.

2. Description of the Prior Art

It is well know and understood that scuba divers use belts which contain weights for helping to offset buoyancy of themselves and their equipment. For different size people, the amount of weight in the belts may vary. Typically, the weights are attached directly to the belt, and when the belt is tightened, the weights are also tightened against the individual and accordingly are uncomfortable.

U.S. Pat. No. 2,558,382 (Previdi) discloses a belt which includes a combination holder for golf balls and holder elements for the tees. The holder apparatus may be secured to an ordinary belt.

U.S. Pat. No. 3,436,777 (Greenwood) discloses a jacket for a diver and a weight belt is attached to the jacket. The weight belt is secured to hooks on the jacket, and weights are in turn secured to the belt.

U.S. Pat. No. 3,664,560 (Perkins) discloses a belt designed for law enforcement officers. A plurality of pouches and other types of elements are secured to the belt. Hook and loop type fasteners are used extensively for the belt and pouches of the other elements.

U.S. Pat. No. 4,174,793 (Wisowaty) discloses a belt to which storage elements are secured by hook and loop type fastener elements. The storage elements are removable, and accordingly may be used with any ordinary belt.

U.S. Pat. No. 4,323,181 (Spasoff) discloses a carrier mounted to a belt. The carrier is designed for carrying fishing tackle. Fixed belt loops on the carrier are used to secure the carrier to a belt. The carrier itself comprises a plurality of different holder elements.

U.S. Pat. No. 4,440,525 (Perla) discloses a weight belt for a diver. The belt includes a plurality of pouches or pockets for receiving weights. The pouches or pockets are integral with the belt. A flap covering the pouches or pockets is used to hold the weights in the pouches or pockets. The flap fits against the divers body to insure that the flap remains in place, thus insuring that the weights do not come loose. It will be noted that the apparatus of the '525 patent typifies the situation where tightening the belt tightens the weights against a divers body.

U.S. Pat. No. 4,732,305 (Courtney et al) discloses another belt in which weight holding pouches are integral with the belt. The pouches are contoured to fit the user's hips. A second embodiment, shown in FIG. 3, discloses weight holding pouches separable from, or adjustable on, the belt.

U.S. Pat. No. 4,798,497 (Bloos) discloses a diving belt on which weights are adjustable. The belt extends through the weights. It will be noted that with the weights extending through the belt, any tightening of the belt will also tighten the weights against the body of the diver.

SUMMARY OF THE INVENTION

The invention described and claimed herein comprises diving belt apparatus in which a sleeve or a plurality of sleeves is adjustably secured to a belt. The sleeve(s) include pouches for holding weights. The pouches, if not in use, may be folded or collapsed for convenience. The pouches for holding the weights are individual pouches secured to a sleeve which is movable or adjustable on the belt. Accordingly, there is no direct contact between the weights or the weight pouches themselves and the diver wearing or using the belt apparatus.

Among the objects of the present invention are the following:

To provide new and useful weight belt for a diver;

To provide new and useful weight belt having a sleeve on the belt and a pouch on the sleeve for holding a weight;

To provide new and useful weight belt having a plurality of pouches for holding weights;

To provide new an useful weight belt apparatus having a plurality of pouches secured to a sleeve;

To provide new and useful sleeve having a plurality of weight holding pouches secured to the sleeve; and To provide new and useful pouches for holding weights and which pouches are collapsible when no weight is disposed therein.

BRIEF DESCRIPTION OF THE DRAWING

FIG. 1 is a perspective view of the apparatus of the present invention.

FIG. 2 is an exploded perspective view of the apparatus of FIG. 1.

FIG. 3 is a view in partial section taken generally along line 2—2 of FIG. 1.

FIG. 4 is a side view in partial section illustrating an alternate operation of the apparatus illustrated in FIG. 2.

DESCRIPTION OF THE PREFERRED EMBODIMENT

FIG. 1 is a perspective view of weight belt apparatus 10 of the present invention. FIG. 2 is an exploded perspective view of a portion of a weight-belt apparatus 10, illustrating the assembly thereof. FIG. 3 is a view in partial section of the weight belt apparatus 10 taken generally along line 3—3 of FIG. 1, and FIG. 4 is a view in partial section sequentially following FIG. 3. For the following discussion, reference will be made to all four of the Figures.

Weight belt apparatus 10 includes a base belt 12 with a buckle 14 at one end and an end 20 remote from the buckle 14. The buckle includes a fixed portion 16 and a clasp 18. For securing the weight belt apparatus 10 to a diver, the clasp 18 is raised from the fixed portion 16 and the end 20 is inserted between the clasp and the fixed portion. The clasp 18 is then pivoted downwardly onto the belt to secure the belt and the buckle. The buckle elements are well known and understood in the art.

A pair of weight sleeves 32 and 64 are disposed on the belt and are disposed between a pair of limit elements or spacer elements 30 and 60. In FIG. 1, a limit or spacer element 30 is shown disposed on the base belt 12 adjacent to, but spaced apart, from the buckle 14. The sleeve 32 is then disposed on the belt and against the limit or spacer element 30. In FIG. 2, the sleeve 32 is shown spaced apart from the end 20 of the belt, with the spacer or limit element 30 already disposed on the base belt 12. The sleeve 32 is then disposed over the base belt 12 and disposed against or adjacent to the spacer or limit element 30. The second limit or spacer element 60 is then disposed on the base belt 12 to limit the movement of the sleeve 32 thereon.

Referring again to FIG. 1, a third spacer element 62 is then placed on the base belt 12 at the desired location, and a sleeve 64 is then placed on the belt 12 and the final spacer or limit element 96 is disposed on the belt, again at the desired location, to limit the movement of the sleeve 64 on the belt 12.

Each sleeve includes three weight pouches, with a weight pouch 36, a weight pouch 44, and a weight pouch 52 being secured to the sleeve 32, and a weight pouch 68, a weight pouch 76, and a weight pouch 84 being secured to the sleeve 64.

Each weight pouch may receive a weight, if the user/diver so desires. Each weight pouch includes a flap to secure a weight in a pouch. The weight pouch 36 includes a flap 40, the weight pouch 44 includes a flap 48, and the weight pouch 52 includes a flap 56.

The weight pouch 68 includes a flap 72, the weight pouch 76 includes a flap 80, and the weight pouch 84 includes a flap 88.

Hook and loop type fasteners are used to secure the flaps to either the weight pockets, if a weight is disposed therein, or to the sleeve element if there is no weight in a particular weight pocket. Thus, the flaps include a hook fastener, and the sleeves and the weight pouches include loop fastener elements. In FIGS. 3 and 4, the pouch 84 is shown secured to the sleeve 64 and the sleeve 64 is in turn disposed on the belt 12. On the bottom rear of the sleeve 64 there is shown a portion of a loop fastener strip 66. On the front upper portion of the pouch 84 there is shown a loop type fastener strip 86. The loop fastener strip 86 is also shown in FIG. 1. On the outer inside tip of the flap 88 there is shown a hook strip 90.

A weight 100 is shown in dash dot line in the pouch 84 in FIG. 3. In such case, the hook strip 90 will be disposed against the loop strip 86 to secure the flap 88 to the pouch 84 to hold the weight 100 in place.

In FIG. 4, the pouch 84 is shown collapsed, with no weight disposed therein. In such case, the flap 88 is then pulled snugly around the pouch 84 and the hook type fastener 90 is then secured to the loop strip 66 on the sleeve 64. In FIG. 4, the loop and hook fastener elements 66 and 90 are shown in their attached or secured orientation.

As best shown in FIGS. 3 and 4, but also as may be understood from FIGS. 1 and 2, each pouch includes a pouch strap secured to a sleeve and curved in a U-shaped configuration to define a pouch or pocket, with a flap extending upwardly and outwardly from the sleeve. A transverse strap is also secured to the sleeve also in a U-shaped configuration and appropriately secured to the upper portion of the pouch. The loop fastener strips for each pouch are secured to the transverse strap. For the pouch 84, a pouch strap 92 is shown, secured to both the sleeve 64 and to a transverse strap 94.

In FIG. 3, the pouch 84 is shown in its open position, with the weight 100 disposed therein, and in FIG. 4, the pouch 84 is shown without a weight and in its collapsed position or orientation.

It will be understood that with a plurality of pouches for holding weights, a weight belt may be tailored to an individual, with one, two, or more, sleeves secured on a belt. With a plurality of individual pouch elements secured to a sleeve, weights may be added or removed individually without removing the entire belt or without even removing an entire sleeve. Thus, the weight belt apparatus 10 may be specifically tailored to a particular individual and for varying circumstances.

While three pouches or pockets are shown on each sleeve 32 and 64, it is obvious that to accommodate users of various sizes and to accommodate use under various circumstances, the sleeves could have as few as a single (one) pouch or as many as practical, which may be four or more pouches. For example, there may be a sleeve, such as the sleeve 32, with only a single weight pouch, such as only the weight pouch 44 on the sleeve. In such case the weight pouch 44 may be relatively larger than illustrated, if desired. Or, there may be two such pouches, both relatively larger than illustrated, if desired. Moreover, a user with a single belt may have several different sleeves, each with a different pouch configuration to be used under different circumstances. Thus, the present apparatus is very flexible in usage, with different sleeve and pouch combinations practical for different diving circumstances.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A weight belt apparatus comprising in combination:

a belt;

a sleeve movably disposed on the belt;

pouch means on the sleeve for receiving weights, including a plurality of pouches and each pouch is adapted to receive a weight a flap for each pouch of the plurality of pouches, and hook and loop fastener elements for securing each flap to its pouch when a weight is in the pouch and to the sleeve when no weight is in the pouch; and means for securing the sleeve at a desired location on the belt.

2. The apparatus of claim 1 in which the means for securing the sleeve at a desired location includes a pair of limit elements movably disposed on the belt.

3. The apparatus of claim 1 in which each pouch of the pouch means includes a pouch strap secured to the sleeve and a transverse strap secured to the sleeve and to the pouch strap.

4. The apparatus of claim 3 in which the hook and loop fastener elements are secured to the flap, to the transverse strap, and to the sleeve.

5. A weight belt apparatus for a scuba diver comprising in combination a belt adapted to be secured to the diver;

a sleeve movable on the belt to a desired location;

pouch means secured tot he sleeve for holding weights including a plurality of pouches, each ouch of which is adapted to receive a weight, and a flap for each pouch of the plurality of pouches for securing a weight in each pouch by being attached to the pouch and for collapsing the pouch against the sleeve be being attached to the sleeve when no weight is in the pouch.

6. The apparatus of claim 5 in which the pouch means further includes a pouch strap secured to the sleeve and a transverse strap secured to the sleeve and to the pouch strap for each pouch of the plurality of pouches.

7. The apparatus of claim 6 in which the pouch means further includes hook and loop fastener elements for selectively securing the flap to the pouch when there is a weight in the pouch and to the sleeve when there is no weight in the pouch.

8. The apparatus of claim 5 which further includes a pair of limit elements movably disposed on the belt for securing the sleeve on the belt at a desired location.

9. The apparatus of claim 8 in which there are a pair of sleeves on the belt, and each sleeve includes a plurality of pouches.

* * * * *